US005687283A

United States Patent [19]

Wake

[11] Patent Number: 5,687,283

[45] Date of Patent: Nov. 11, 1997

[54] PAUSE COMPRESSING SPEECH CODING/ DECODING APPARATUS

[75] Inventor: Yasuhiro Wake, Tokyo, Japan

[73] Assignee: Nec Corporation, Tokyo, Japan

[21] Appl. No.: 653,705

[22] Filed: May 23, 1996

[30] Foreign Application Priority Data

May 23, 1995 [JP] Japan ..... 7-123958

[51] Int. Cl.[6] ..... G10L 9/00

[52] U.S. Cl. ..... 395/2.24; 395/2.35; 395/2.42; 395/2.1

[58] Field of Search ..... 395/2.1, 2.42, 395/2.09, 2.35, 2.34, 2.36, 2.37, 2.24, 2.91, 2.92, 2.2; 379/80

[56] References Cited

U.S. PATENT DOCUMENTS

| | | | |
|---|---|---|---|
| 4,630,262 | 12/1986 | Callens et al. | 370/81 |
| 4,860,356 | 8/1989 | Visser | 395/2.42 |
| 4,893,197 | 1/1990 | Howells et al. | 360/8 |
| 4,903,301 | 2/1990 | Kondo et al. | 395/2.92 |
| 4,918,734 | 4/1990 | Muramatsu et al. | 395/2.23 |
| 5,251,261 | 10/1993 | Meyer et al. | 395/2.2 |
| 5,414,796 | 5/1995 | Jacobs et al. | 395/2.3 |
| 5,485,522 | 1/1996 | Solve et al. | 395/2.35 |
| 5,539,858 | 7/1996 | Sasaki et al. | 395/2.21 |
| 5,553,080 | 9/1996 | Fijiwara | 371/5.1 |
| 5,553,190 | 9/1996 | Ohya | 395/2.1 |
| 5,563,912 | 10/1996 | Yasunaga | 375/242 |
| 5,581,651 | 12/1996 | Ishino | 395/2.14 |

FOREIGN PATENT DOCUMENTS

| | | | |
|---|---|---|---|
| 107933 | 6/1985 | Japan | H04B 14/06 |
| 127300 | 5/1988 | Japan | G10L 9/18 |
| 36628 | 2/1990 | Japan | H04B 14/04 |
| 206246 | 8/1990 | Japan | H04J 3/17 |

OTHER PUBLICATIONS

IEEE Pacific Rim Conference on communications, Computers and Signal processing, Rose et al., "Real-time implementation and evaluation of an adaptive silence deletion algorithm for speech compression", vol. 2, pp. 461–468, May 1991.

1990 IEEE International Symposium on Circuits and systems, Shoji et al, "A speech processing LSI for ATM network subscriber", vol. 4, pp. 2897–2900, May 1990.

IBM Technical Disclosure Bulletin, Crauwels et al, "Pause Compression", vol. 25 No. 7B pp. 3963–3964, Dec. 1982.

*Primary Examiner*—Allen R. Macdonald
*Assistant Examiner*—Richemond Dorvil
*Attorney, Agent, or Firm*—Sughrue,Mion,Zinn,Macpeak & Seas, PLLC

[57] ABSTRACT

A pause compressing speech coding/decoding apparatus according to the invention can improve the sound quality of decoded speech in terms of sense of hearing, in which the transmission side includes a speech coder, a speech detector, a hangover time controller for adjusting the duration of a speech interval, and a switch for outputting only coded data in a speech interval to a line, and the reception side includes a speech decoder, a noise generator, an amplifier for controlling the output level of the noise generator, a selector for selecting/outputting one of outputs from the speech decoder and the noise generator, a speech/pause data detector for detecting speech/pause data of data from the line, a gain controller for calculating the gain of the amplifier, a level calculator for calculating the signal level of reproduced speech from the speech decoder, and a memory for storing past level values calculated by the level calculator.

3 Claims, 2 Drawing Sheets

PAUSE COMPRESSING SPEECH CODING/ DECODING APPARATUS

BACKGROUND OF THE INVENTION

1. Field of the Invention

The present invention relates to a high-efficiency speech coding/decoding apparatus in which a speech signal in a telephone band is transmitted as high-efficiency coded digital data, and the coded data received on the decoding side is subjected to inverse transformation to be decoded/output as a reproduced speech signal in the telephone band and, more particularly, to a pause compressing speech coding/decoding apparatus in which speech/pause of a telephone-band speech signal input to a high-efficiency speech coding/decoding section is detected, only the coded data in a speech interval is transmitted, and a decoding section decodes the received data in the speech interval to output the decoded data as reproduced speech while generating noise in a pause interval.

2. Description of the Prior Art

A pause compressing speech coding/decoding apparatus for detecting the speech/pause of input speech and coding/transmitting the speech data in the speech interval has been studied and developed as an effective speech compression means using statistical characteristics associated with the speech or talkspurts generation rate in telephone speech communication.

In such a conventional pause compressing speech coding/decoding apparatus, since the coded data in a pause interval is not transmitted, the decoding side outputs completely pause data (0 V) as an output in the pause interval. In order to realize more natural speech communication, a function of outputting random noise in a pause interval is provided for such an apparatus. With this function, more natural speech communication is attained.

It is known that, in performing insertion/superimposition of the above random noise in a pause interval, the naturalness of speech communication can be improved by faithfully decoding/reproducing the level of background noise rather than inserting noise having a constant level.

In the speech signal coding/decoding apparatus disclosed in Japanese Unexamined Patent Publication No. 60-107933, the speech coding side measures the level of background noise and transmits the noise level, and the decoding side inserts/superimposes random noise corresponding to the transmitted noise level, and outputs the resultant data.

In the speech coding/decoding apparatus disclosed in Japanese Unexamined Patent Publication No. 02-206246, input speech to a coder is divided into predetermined frames, and a significant noise interval is defined in addition to determination of speech/pause. A signal in this significant noise interval is coded and transmitted to reproduce noise in a pause interval, thereby realizing more natural speech communication.

In the speech signal transmission/reception scheme disclosed in Japanese Unexamined Patent Publication No. 02-36628, coded data in a noise interval determined by speech/pause determination is transmitted together with an identification code, and noise reproduction is performed on the reception side on the basis of the transmitted identification information.

In the above pause compression apparatuses, noise information in a pause interval of data transmitted from the coding side is coded data obtained by a noise coder or only information representing the level of noise. In all these apparatuses, background noise information in a interval must also be transmitted. In addition, on the reception side, it is necessary to check whether the transmitted digital data is information in a speech interval or in a pause interval, resulting in a complicated apparatus arrangement.

In a pause compression apparatus having such an arrangement, since information must be transmitted even in a pause interval, transmission efficiency and compression efficiency deteriorate.

In the pause compression scheme disclosed in Japanese Unexamined Patent Publication No. 63-127300, noise level data to be reproduced is generated by performing interpolation between speech intervals before and after a pause interval on the decoding side, and the noise is superimposed on the decoded speech.

In this scheme, since no information needs to be transmitted in a pause interval, no deterioration in transmission efficiency occurs. In many cases, however, the noise level in an interpolated pause interval does not coincide with background noise on the transmission side, resulting in a deterioration in the naturalness of speech communication.

In the conventional pause compression apparatuses (Japanese Unexamined Patent Publication Nos. 60-107933, 02-206246, and 02-36628), since even a noise signal in a pause interval must be coded and transmitted, the apparatus arrangement on the decoding side is complicated, and speech signal transmission efficiency and compression efficiency deteriorate.

In the pause compression scheme disclosed in Japanese Unexamined Patent Publication No. 63-127300, since no information needs to be transmitted in a pause interval, no deterioration in transmission efficiency occurs. However, since a means for estimating the noise level in a pause interval is interpolation between speech intervals, the estimated noise level does not coincide with background noise on the transmission side in many cases, resulting in a deterioration in the naturalness of speech communication.

SUMMARY OF THE INVENTION

It is an object of the present invention to provide a pause compressing speech coding/decoding apparatus which have excellent transmission efficiency and compression efficiency and has more natural background noise.

According to one aspect of the present invention, there is provided a pause compressing speech coding/decoding apparatus comprising a high-efficiency speech coding section for performing high-efficiency coding of a telephone-band speech signal and transmitting coded data to a digital transmission path, and a high-efficiency speech decoding section for performing reverse transformation of the coded data received through the digital transmission path and decoding the data as a telephone-band speech signal, the apparatus being adapted to detect speech/pause of the telephone-band speech signal input to the high-efficiency speech coding section and transmit only coded data in a speech interval of the speech signal, the high-efficiency speech coding section including speech coding means for coding an input telephone-band speech signal into digital data, and outputting the data as a digital speech signal, speech detection means for outputting speech/pause information of the input speech by monitoring power of the input telephone-band speech signal, a hangover time controller for, when speech is determined by the speech detection means, adjusting a time during which the speech is determined, and a switch for transmitting only coded data in a speech interval including the time adjusted by the hangover time controller to the digital transmission path, the hangover time controller having means for turning off the switch, which controls transmission of the coded data to the transmission path, with a delay of a predetermined period of time, when a result from the speech detection means changes from speech to pause, instead of immediately turning off the switch, the high-efficiency speech decoding section including speech decoding means for receiving the coded data received from the digital transmission path, and decoding the data into a speech signal, a noise generator, an amplifier for amplifying or attenuating an output level of the noise generator, a selector for selecting/outputting one of outputs from the speech decoding means and the noise generator, speech/pause data detector for detecting speech/pause data of the coded data received from the digital transmission path, a gain controller for calculating a gain of the amplifier, a level calculator for calculating a signal level of reproduced speech from the speech decoding means, and a memory for receiving and storing a level value calculated by the level calculator, the speech/pause data detector having means for controlling the selector to select an output from the speech decoding means when the coded data is received from the digital transmission path, and controlling the selector to select an output from the noise generator when the coded data is not received from the digital transmission path, the level calculator having means for receiving a reproduced speech signal as an output from the speech decoding means, and, when the speech/pause data detector detects a change from speech to pause, calculating a signal level in a predetermined period of time immediate before the change from speech to pause, and inputting the calculated level to the memory, the memory allowing a level value calculated by the level calculator to be written therein every time a detection result from the speech/pause data detector changes from speech to pause, and having a function of holding the level values in the past, and the gain controller having means for reading out the level value from the memory every time a detection result from the speech/pause data detector changes from speech to pause, and using the readout value as an amplification or attenuation value for the amplifier.

According to another aspect of the present invention, the pause compressing speech coding/decoding apparatus defined in claim 1 is characterized in that the memory allows a level value calculated by the level calculator to be written therein every time a detection result from the speech/pause data detector changes from speech to pause, and has a function of holding the level values in the past, and the gain controller has means for reading out the level value from the memory every time a detection result from the speech/pause data detector changes from speech to pause, calculating an average value of past level values held in the memory, and using the average value as an amplification or attenuation value for the amplifier.

According to further aspect of the present invention, the pause compressing speech coding/decoding apparatus defined in claim 1 is characterized in that the memory allows a level value calculated by the level calculator to be written therein every time a detection result from the speech/pause data detector changes from speech to pause, and has a function of holding the level values in the past, and the gain controller has means for reading out the level value from the memory every time a detection result from the speech/pause data detector changes from speech to pause, calculating a minimum value of past level values held in the memory, and using the minimum value as an amplification or attenuation value for the amplifier.

DETAILED DESCRIPTION OF THE PREFERRED EMBODIMENT

The present invention will now be described with reference to the accompanying drawings.

Figure 1:
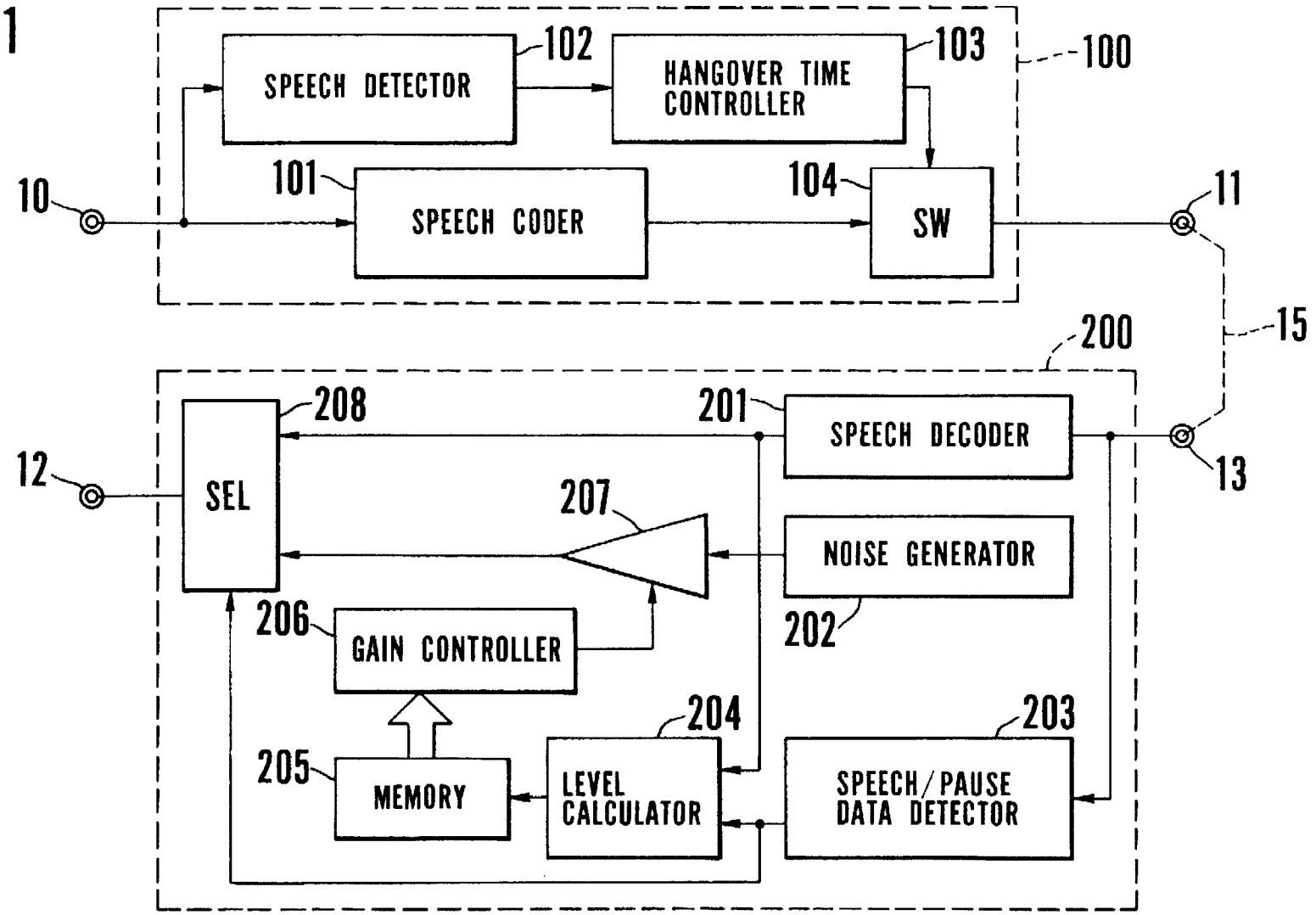
FIG. 1 is a block diagram showing a pause compressing speech coding/decoding apparatus according to an embodiment of the present invention.

FIG. 1 is a block diagram showing a pause compressing speech coding/decoding apparatus according to an embodiment of the present invention.

Referring to FIG. 1, a high-efficiency speech coding section 100 receives a speech signal in a telephone band via a terminal 10. In addition, the speech coding section 100 outputs coded data to a transmission line (digital transmission path) 15 via a terminal 11.

The speech coding section 100 comprises a speech coder (speech coding means) 101 for converting a speech signal input through the terminal 10 into digital data of a low bit rate, a speech detector (speech detection means) 102 for monitoring the power of the speech signal input through the terminal 10 and detecting speech/pause, a hangover time controller 103 for controlling the speech time upon reception of the detection result from the speech detector 102, and a switch 104 for outputting only coded data in a speech interval to the digital transmission line 15.

A high-efficiency speech decoding section 200 comprises a speech decoder (speech decoding means) 201 for decoding coded data input through a terminal 13 and outputting the resultant data as reproduced speech, a speech/pause data detector 203 for detecting an interval in which no speech data is received from the transmission line 15, i.e., a pause interval, a noise generator 202, a level calculator 204 for simultaneously receiving an output from the speech/pause data detector 203 and an output from the speech decoder 201 to calculate and output the power of a portion corresponding to a hangover time in a speech interval, a memory 205 for sequentially storing outputs from the level calculator 204, a gain controller 206 for reading out level information stored in the memory 205 and calculating the gain of an amplifier, an amplifier 207 for amplifying or attenuating an output from the noise generator 202 on the basis of the result from the gain controller 206, and a selector 208 for selecting an output from the speech decoder 201, which is based on an output from the speech/pause data detector 203, or an output from the noise generator 202, which has been processed by the amplifier 207, and outputting the selected output to an output terminal 12.

The operation of this apparatus will be described.

In the speech coding section 100, a signal in the telephone band is input to the speech coder 101 and the speech detector 102 via the terminal 10 at once.

The speech coder 101 executes coding processing to code the input speech signal into digital data.

The speech detector 102 always monitors the power of an input speech signal, and outputs a determination result indicating that a signal having power equal to or higher than a threshold is speech data, and a signal having power lower than the threshold is pause data.

The hangover time controller 103 delays determination of a speech interval by a predetermined period of time when an output from the speech detector 102 changes from speech data to pause data, and turns off the switch 104. When an output from the speech detector 102 changes from pause data to speech data, the hangover time controller 103 immediately turns on the switch 104.

Figure 2:
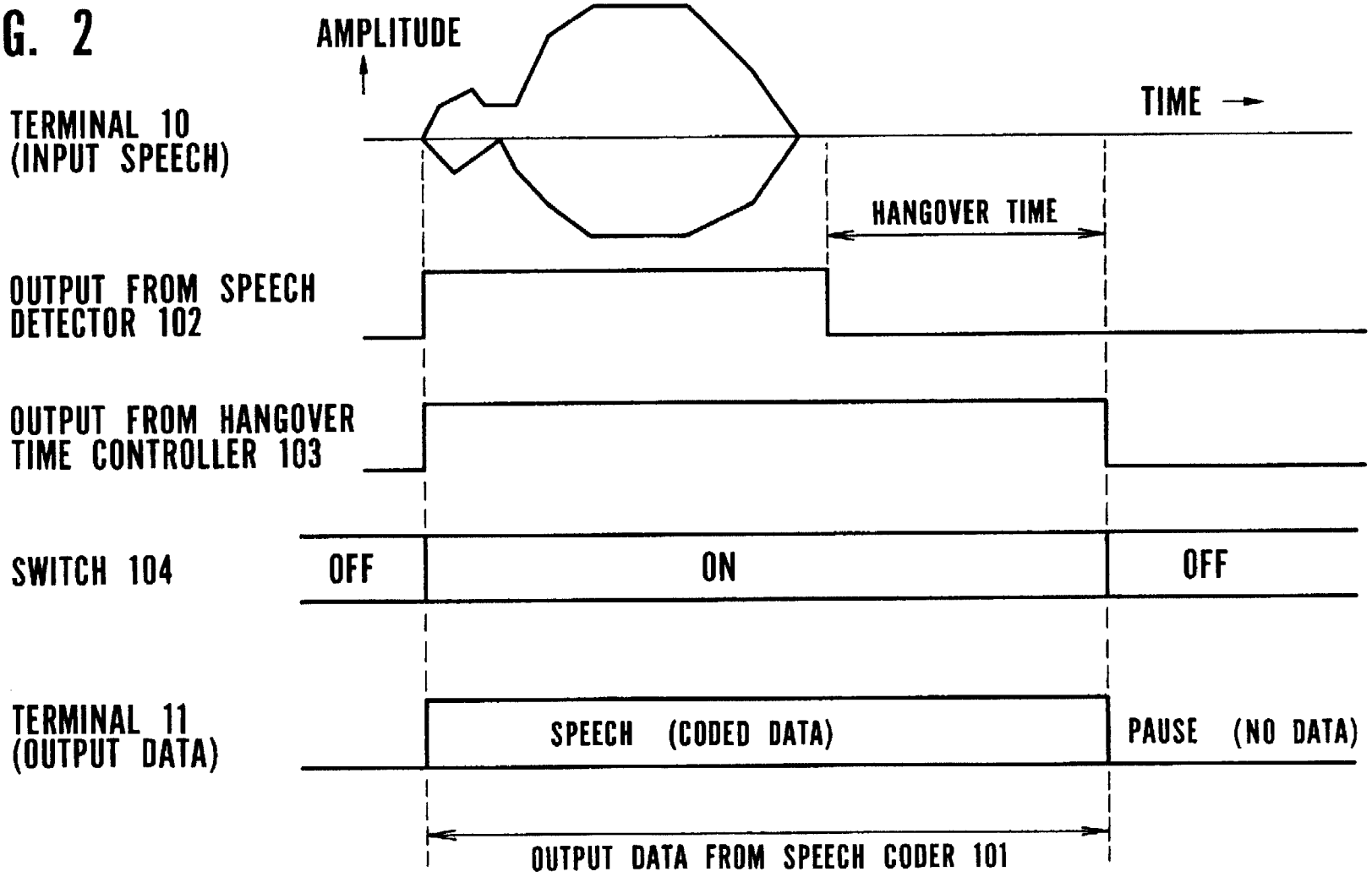
FIG. 2 is a graph showing the relationship in timing between a speech signal, coded data, and a switch.

FIG. 2 shows the relationship in timing between a speech signal input through the terminal 10 and coded data output from the terminal 11 under this control, together with control of the switch 104.

In the speech decoding section 200, a data signal input through the terminal 13 is input to the speech decoder 201 and the speech/pause data detector 203 at once.

The speech/pause data detector 203 switches the selector 208 to the output side of the speech decoder 201 to output the input signal only when the input signal from the line contains coded data from the speech coding section 100. If no data is received from the line, i.e., the speech coding section 100 turns off the switch 104 so as not to transmit data to the line, the selector 208 is switched to the output of the amplifier 207 to output the input signal to the output terminal 12.

The speech decoder 201 decodes data received in a speech interval. The speech decoder 201 outputs reproduced speech to the selector 208 and the level calculator 204 at once.

When a change from speech data to pause data is detected by the speech/pause data detector 203, the level calculator 204 calculates the signal level at the end of a speech interval of the reproduced speech upon retroacting to a predetermined period of time before a time point when pause data is detected. The result obtained by the level calculator 204 is sequentially stored in the memory 205. Every time a change from speech data to pause data occurs, level information is input to the memory 205. Pieces of level information at the ends of several speech intervals in the past are held in the memory 205 (for example, pieces of level information corresponding to 10 speech intervals in the past are always stored).

The gain controller 206 reads out pieces of level information at the ends of pause intervals in the past from the memory 205, calculates the average value of the information, and outputs it as a noise amplification value.

The gain controller 206 may be designed to output the minimum signal level stored in the memory 205 as an amplification value to the amplifier 207 instead of outputting the average value of levels at the ends of speech intervals in the past.

The amplifier 207 amplifies noise output from the noise generator 202, and outputs the resultant data to the selector 208.

As has been described above, according to the present invention, unlike the conventional pause compression apparatuses, the background noise level on the transmission side can be reproduced on the reception side without transmitting information associated with a noise signal in a pause interval as transmission information for the pause compressing speech coding/decoding apparatus, i.e., output information from the transmission side, i.e., the coding side. Therefore, transmission efficiency and compression efficiency can be improved.

In addition, the level of noise to be reproduced in a pause interval on the reception side, i.e., the decoding side, can be calculated as an end portion of each speech interval determined as speech data on the transmission side, i.e., signal level information in an interval having a signal level almost corresponding to the level of pause data on the basis of information on only the decoding side. For this reason, the background noise in speech communication changes in accordance with the transmission side. More natural speech communication can be realized in the apparatus of the present invention as compared with the conventional pause compression apparatuses for reproducing noise at a predetermined level.

What is claimed is:

1. A pause compressing speech coding/decoding apparatus comprising a high-efficiency speech coding section for performing high-efficiency coding of a telephone-band speech signal and transmitting coded data to a digital transmission path, and a high-efficiency speech decoding section for performing reverse transformation of the coded data received through the digital transmission path and decoding the data as a telephone-band speech signal, said apparatus being adapted to detect speech/pause of the telephone-band speech signal input to said high-efficiency speech coding section and transmit only coded data in a speech interval of the speech signal, said high-efficiency speech coding section including:

speech coding means for coding an input telephone-band speech signal into digital data, and outputting the data as a digital speech signal;

speech detection means for outputting speech/pause information of the input speech by monitoring power of the input telephone-band speech signal;

a hangover time controller for, when speech is determined by said speech detection means, adjusting a time during which the speech is determined; and a switch for transmitting only coded data in a speech interval including the time adjusted by said hangover time controller to the digital transmission path, said hangover time controller having means for turning off said switch, which controls transmission of the coded data to the transmission path, with a delay of a predetermined period of time, when a result from said speech detection means changes from speech to pause, instead of immediately turning off said switch, said high-efficiency speech decoding section including:

speech decoding means for receiving the coded data received from the digital transmission path, and decoding the data into a speech signal;

a noise generator;

an amplifier for amplifying or attenuating an output level of said noise generator;

a selector for selecting/outputting one of outputs from said speech decoding means and said noise generator;

speech/pause data detector for detecting speech/pause data of the coded data received from the digital transmission path;

a gain controller for calculating a gain of said amplifier;

a level calculator for calculating a signal level of reproduced speech from said speech decoding means; and a memory for receiving and storing a level value calculated by said level calculator, said speech/pause data detector having means for controlling said selector to select an output from said speech decoding means when the coded data is received from the digital transmission path, and controlling said selector to select an output from said noise generator when the coded data is not received from the digital transmission path, said level calculator having means for receiving a reproduced speech signal as an output from said speech decoding means, and, when said speech/pause data detector detects a change from speech to pause, calculating a signal level in a predetermined period of time immediate before the change from speech to pause, and inputting the calculated level to said memory, said memory allowing a level value calculated by said level calculator to be written therein every time a detection result from said speech/pause data detector changes from speech to pause, and having a function of holding the level values in the past, and said gain controller having means for reading out the level value from said memory every time a detection result from said speech/pause data detector changes from speech to pause, and using the readout value as an amplification or attenuation value for said amplifier.

2. An apparatus according to claim 1, wherein said memory allows a level value calculated by said level calculator to be written therein every time a detection result from said speech/pause data detector changes from speech to pause, and has a function of holding the level value in the past, and said gain controller has means for reading out the level value from said memory every time a detection result from said speech/pause data detector changes from speech to pause, calculating an average value of past level values held in said memory, and using the average value as an amplification or attenuation value for said amplifier.

3. An apparatus according to claim 1, wherein said memory allows a level value calculated by said level calculator to be written therein every time a detection result from said speech/pause data detector changes from speech to pause, and has a function of holding the level value in the past, and said gain controller has means for reading out the level value from said memory every time a detection result from said speech/pause data detector changes from speech to pause, calculating a minimum value of past level values held in said memory, and using the minimum value as an amplification or attenuation value for said amplifier.

* * * * *